US008517194B2

(12) United States Patent
Bloom et al.

(10) Patent No.: US 8,517,194 B2
(45) Date of Patent: Aug. 27, 2013

(54) TAMPER-INDICATING CLOSURE AND PACKAGE

(75) Inventors: Kenneth S. Bloom, Bloomdale, OH (US); Stephen A. Eilertson, Perrysburg, OH (US); Wendell D. Willingham, Perrysburg, OH (US)

(73) Assignee: Berry Plastics Corporation, Evansville, IN (US)

( * ) Notice: Subject to any disclaimer, the term of this patent is extended or adjusted under 35 U.S.C. 154(b) by 2183 days.

(21) Appl. No.: 10/799,114

(22) Filed: Mar. 11, 2004

(65) Prior Publication Data

US 2005/0199574 A1 Sep. 15, 2005

(51) Int. Cl.
*B65D 41/34* (2006.01)

(52) U.S. Cl.
USPC ..... 215/252; 215/258

(58) Field of Classification Search
USPC ..... 215/252, 258
See application file for complete search history.

(56) References Cited

U.S. PATENT DOCUMENTS

| | | | | |
|---|---|---|---|---|
| 4,418,828 | A | 12/1983 | Wilde et al. | |
| 4,496,302 | A | 1/1985 | Brown | |
| 4,497,765 | A | 2/1985 | Wilde et al. | |
| 4,548,329 | A * | 10/1985 | Curry | 215/216 |
| 4,609,115 | A * | 9/1986 | Moore et al. | 215/252 |
| 4,749,094 | A * | 6/1988 | Fuchs | 215/252 |
| 4,784,281 | A | 11/1988 | Rozenberg | |
| 4,909,404 | A | 3/1990 | Rozenberg | |
| 5,320,233 | A | 6/1994 | Welch | |
| 5,320,234 | A | 6/1994 | Kamath | |
| 5,803,286 | A | 9/1998 | Pfefferkorn et al. | |
| 5,915,579 | A * | 6/1999 | Przytulla et al. | 215/252 |
| 5,957,315 | A | 9/1999 | Kaitsuka | |
| 6,085,921 | A | 7/2000 | Brown | |
| 6,089,390 | A | 7/2000 | Druitt et al. | |
| 6,112,922 | A | 9/2000 | Nofer et al. | |
| 6,112,923 | A | 9/2000 | Ma | |
| 6,116,443 | A | 9/2000 | Parrinello | |
| 6,253,939 | B1 | 7/2001 | Wan et al. | |
| 6,308,848 | B1 | 10/2001 | Parrinello | |
| 6,325,225 | B1 | 12/2001 | Druitt et al. | |
| 6,382,444 | B1 | 5/2002 | Nyman | |
| 6,557,714 | B2 * | 5/2003 | Babcock et al. | 215/252 |
| 2001/0015341 | A1 | 8/2001 | Higgins | |
| 2002/0030031 | A1 | 3/2002 | Druitt | |
| 2002/0079282 | A1 | 6/2002 | Harrold et al. | |
| 2003/0034323 | A1 | 2/2003 | Smith et al. | |
| 2003/0102280 | A1 | 6/2003 | Odet et al. | |

FOREIGN PATENT DOCUMENTS

| | | | |
|---|---|---|---|
| JP | 6-156516 | * | 6/1994 |
| JP | 06-263156 | | 9/1994 |
| JP | 08-113254 | | 5/1996 |

* cited by examiner

*Primary Examiner* — Robin Hylton
(74) *Attorney, Agent, or Firm* — Barnes & Thornburg LLP

(57) ABSTRACT

A tamper-indicating closure that includes a base wall having a cylindrical skirt for removably engaging a container finish. A tamper band is frangibly connected to the skirt, and a plurality of wings extend inwardly from an inner surface of the tamper band for engagement with a container finish. The wings are resiliently flexibly connected to the inner surface of the band along lines that are disposed at a counterclockwise angle with respect to the axis of the skirt as viewed from inside the skirt.

12 Claims, 5 Drawing Sheets

TAMPER-INDICATING CLOSURE AND PACKAGE

The present invention relates to tamper-indicating closures, packages and methods of manufacture, and more particularly to a tamper-indicating closure having wings for engaging ratchet teeth on a container finish for separating a tamper band from the closure skirt.

BACKGROUND AND OBJECTS OF THE INVENTION

It is conventional to provide a tamper-indicating closure that includes a band frangibly connected to the closure skirt and wing-shaped elements extending inwardly from the tamper band for engagement with a bead on a container finish. The wings are flat and flexibly connected to the inner surface of the band along lines that are disposed at a clockwise or positive angle with respect to the axis of the skirt as viewed from inside the skirt. Such wing-type tamper-indicating closures conventionally are fabricated in molds using a straight stripping demolding action rather than an unthreading action.

Although the wing-type tamper-indicating closures of the prior art have been employed for bead-type packages such as carbonated beverage packages, the wing-type tamper indicating closures of the prior art are not well suited for use in combination with containers having ratchet-type tamper indicating means on the container finish. Nor are the closures of the prior art well-suited for fabrication in an injection molding operation of the type in which it is necessary to unthread the closure from the mold core, as opposed to merely axially stripping the closure from the mold core. In such manufacturing applications, positive angle wings on the tamper band are folded and permanently deformed as the closure is unthreaded from the mold core. One object of the present invention is to provide a closure and method of manufacture in which wing-type tamper elements are molded onto the inside of the tamper band in a molding operation in which the closure is unthreaded from the mold core, and in which the wing elements are not distorted or permanently depressed as the core is unthreaded from the closure. Another object of the present invention is to provide a tamper-indicating package that includes such a closure, and a container for use in combination with such a closure in a tamper-indicating package.

SUMMARY OF THE INVENTION

The present invention involves a number of differing aspects, which may be implemented separately from or more preferably in combination with each other.

A tamper-indicating closure in accordance with one aspect of the present invention includes a base wall having a cylindrical skirt for removably engaging a container finish. A tamper band is frangibly connected to the skirt, and a plurality of wings extend inwardly from an inner surface of the tamper band for engagement with a container finish. The wings are flexibly resiliently connected to the inner surface of the band along lines that are disposed at a counterclockwise or negative angle with respect to an axis of the skirt as viewed from inside the skirt. In an exemplary but presently preferred embodiment of the invention, the tamper band includes a portion that is stepped radially outwardly with respect to the skirt and is contiguously connected to the skirt by an interconnecting wall portion. The wings are integrally connected to both the, stepped and the interconnecting wall portion of the band, such that the stiffness of the wings to flexure with respect to the band is greater adjacent to the interconnecting wall portion than remote from the interconnecting wall portion.

A tamper-indicating package in accordance with another aspect of the invention includes a container having a finish with at least one external thread segment, and a plurality of external ratchet teeth spaced from the thread segment. A tamper-indicating closure includes a base wall having a skirt with at least one internal thread segment for engagement with the container finish, and a tamper band frangibly connected to the skirt. A plurality of wings extend inwardly from an inner surface of the tamper band for engagement with the external ratchet teeth on the container finish. The wings are flexibly resiliently connected to the inner surface of the band along lines that are disposed at a counterclockwise angle with respect to an axis of the skirt as viewed from inside the skirt. In the preferred embodiment of the invention, the angular spacing between the wings is less than the angular spacing between the ratchet teeth, and most preferably is one-half of the angular spacing between the ratchet teeth. The wings in this preferred construction cooperate with each other to prevent removal of the closure from the container finish without frangibly separating the tamper band from the closure skirt.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
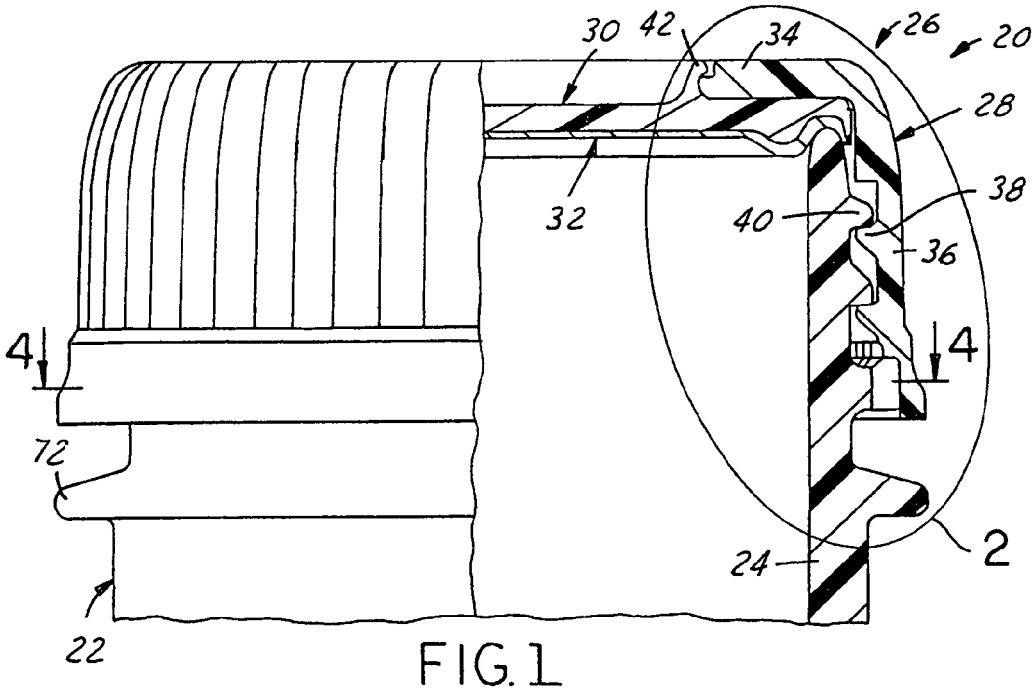
FIG. 1 is a fragmentary partially sectioned elevational view of a closure and container package in accordance with one presently preferred embodiment of the invention.
Figure 2:
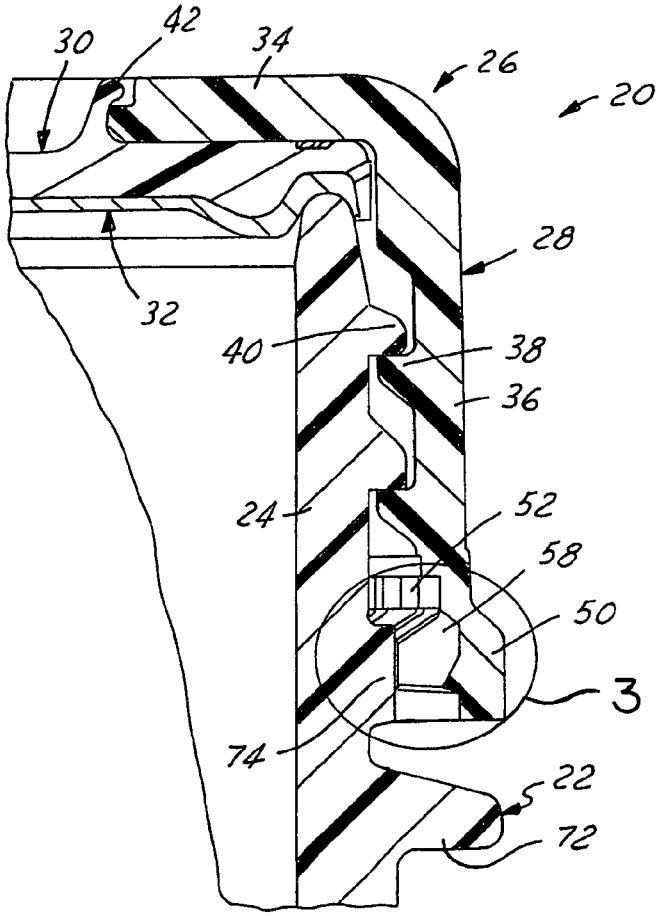
FIG. 2 is an enlarged fragmentary sectional view of the portion of FIG. 1 within the area 2.
Figure 3:
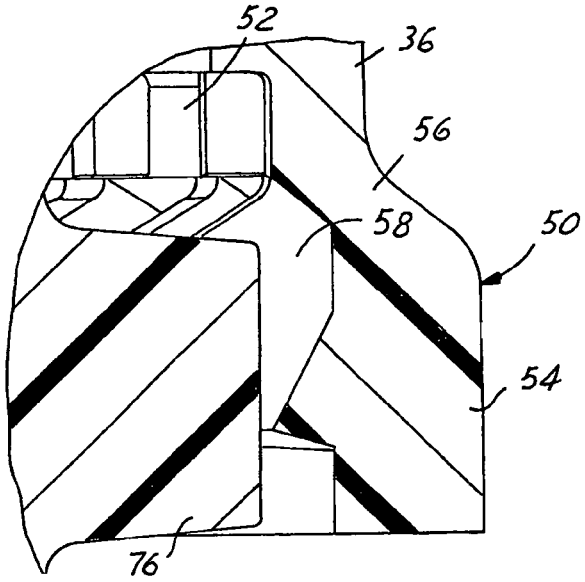
FIG. 3 is a fragmentary sectional view of the portion of FIG. 2 within the area 3.

FIGS. 1-2 illustrate a closure and container package 20 in accordance with one presently preferred but exemplary embodiment of the invention as comprising a container 22 having a cylindrical neck finish 24. A closure 26 is externally secured to container finish 24. Closure 26 in the illustrated embodiment of the invention is an assembly that includes a ring-shaped closure shell 28, a liner disc 30 and a sealing liner 32 on the underside of disc 30. Closure shell 28 includes a base wall 34 and a peripheral skirt 36 having one or more internal thread segments 38 for engagement with one or more external thread segments 40 on container finish 24. Disc 30 has axially extending fingers 42 for mounting disc 30 within a central opening in shell base wall 34. Liner 32 preferably is molded in situ on the underside of disc 30. To the extent thus far described, closure 26 is similar to that disclosed in U.S. application Ser. No. 10/217,691 assigned to the assignee of the present application. The disclosure of such application is incorporated herein by reference for background and for further discussion of the closure assembly to the extent thus far described.

In accordance with the present invention, a tamper-indicating band 50 is frangibly connected to the lower edge of closure skirt 36. (Directional words such as "upper" and "lower" are employed by way of description and not limitation with respect to the upright orientation of the package illustrated in FIGS. 1 and 2. Directional words such as "axial" and "radial" are employed by way of description and not limitation with respect to the axis of the container finish or the closure skirt as applicable.) Such frangible interconnection may be by means of leaders 52 that interconnect skirt 36 with band 50 as molded, by means of frangible bridges that are scored into the closure skirt as disclosed for example in U.S. Pat. No. 5,564,319, or by a combination of molded leaders and scoring. The frangible interconnection less preferably may be in the form of a thin web that integrally interconnects the band with the skirt. In the preferred embodiment of the invention, tamper-indicating band 50 includes a substantially cylindrical portion 54 that is stepped radially outwardly from skirt 36, and an interconnecting conical wall portion 56 that integrally connects cylindrical portion 54 to the closure skirt.

Figure 8:
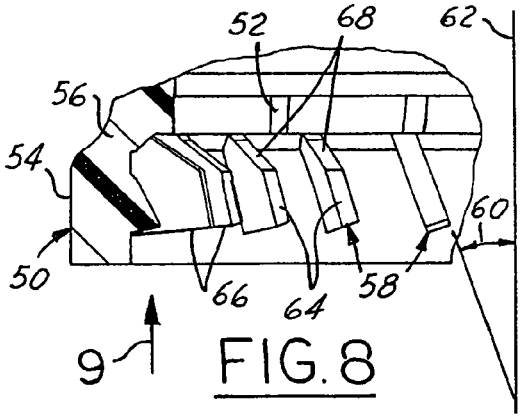
Figure 9:
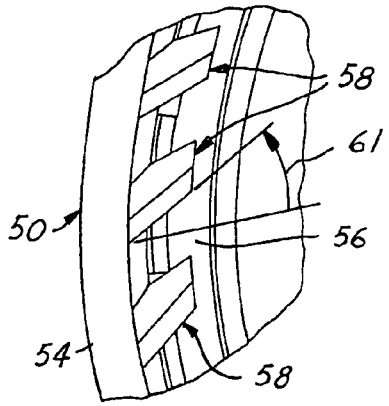
FIG. 9 is a bottom plan view from the direction 9 in FIG. 8.
Figure 10:
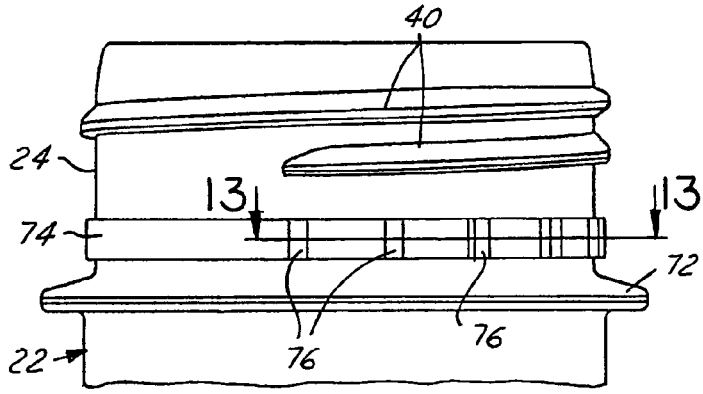
FIG. 10 is a fragmentary elevational view of the finish of the container in the package of FIGS. 1 and 2.

A plurality of wing-shaped elements (wings) 58 extend inwardly from the inner surface of tamper band 50. All wings 58 preferably are identical. Each wing 58 nominally is flat or planar, although the wings could exit the mold slightly non-planar from mold tolerances or because of slight distortion from de-molding. Each wing 58 is flexibly and resiliently connected to the inner surface of band 54 along a line that is at a counterclockwise angle 60 (FIG. 8) with respect to the axis 62 of closure skirt 36, as viewed from inside of the skirt. This counterclockwise or "negative" tilt angle 60 facilitates removal of the closure from the injection mold core without substantial permanent deformation or distortion of wings 58, as will be described. Angle 60 is greater than 0°, preferably 18° to 35°, more preferably 18°. Each wing 58 preferably is of nominally uniform thickness, preferably 0.024 to 0.03 inch thick. Wings 58 preferably are uniformly angularly spaced around the inner periphery of band 50, at a spacing of 10° in the illustrated preferred but exemplary embodiment of the invention. Each wing 58 is generally trapezoidal, having an outer edge integrally coupled to band 50, an inner edge 64 parallel to axis 62, a lower edge 66 and an upper edge 68. Lower edge 66 desirably is parallel to the plane of base wall 34, and typically is at an angle of −5 to +50 to the base wall. Upper edge 68, which faces closure base wall 34, is at an angle to base wall 34 in the range of 25° to 45°, most preferably 35°. The upper edge of each wing 58 also is integrally coupled to and extends from the inside surface interconnecting portion 56 of band 50, so that each wing 58 is most flexible with respect to band 50 at lower edge 66 and least flexible with respect to band 50 at upper edge 68. Stated differently, the flexibility of each wing 58 decreases from the lower edge 66 to the upper edge 68. As viewed from the axial direction through the open end of shell 28 (FIG. 9), the wings are at a clockwise angle 61, with respect to the shell diameter, in the preferred range of 25° to 70°.

Figure 11:
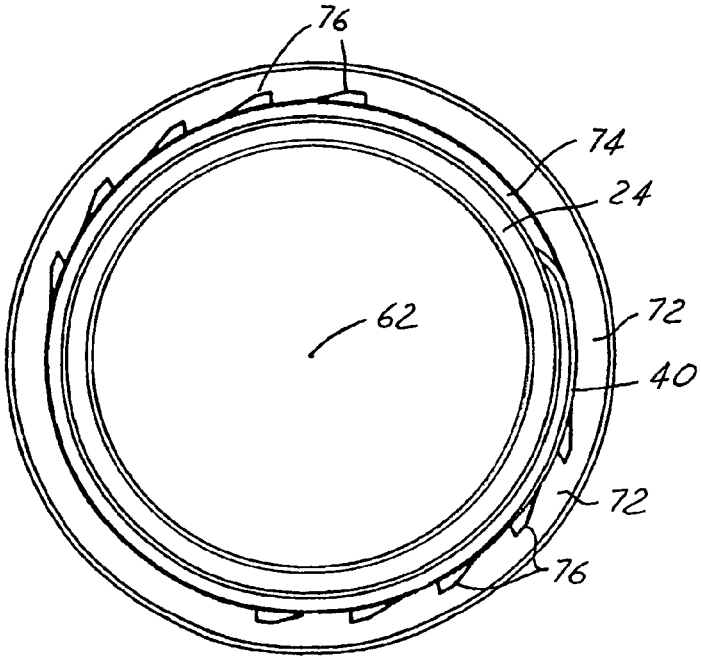
FIG. 11 is a top plan view of the container finish in FIG. 10.
Figure 12:
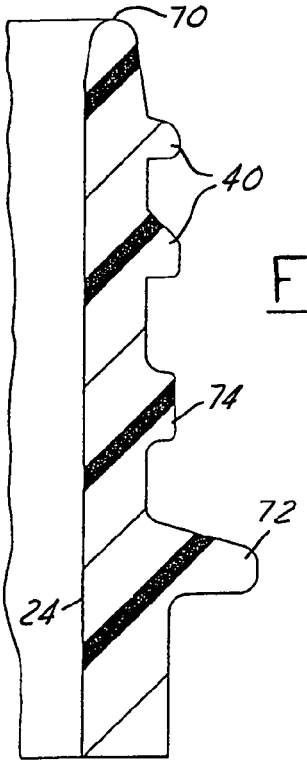
FIG. 12 is a fragmentary sectional view of the container finish in FIGS. 10-11.
Figure 13:
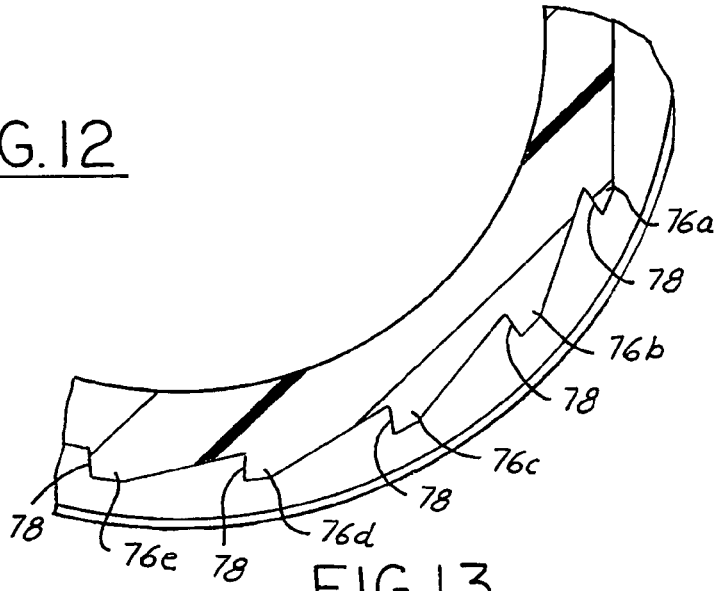
FIG. 13 is a fragmentary sectional view taken substantially along the line 13-13 in FIG. 10.

Container finish 24 is illustrated in greater detail on FIGS. 10-13. Finish 24 has an open upper end 70 that defines the mouth of the container. External thread segments 40 are disposed beneath upper end 70. An external support flange 72 optionally is provided at a position is spaced from open end 70. An external ledge 74 extends around finish 24 at a position beneath thread segments 40. A plurality of ratchet teeth 76 extend radially outwardly from ledge 74. As best seen in FIG. 11, ratchet teeth 76 preferably are provided in two diametrically opposed groups on finish 24, with a substantial angular spacing between the groups and within which no ratchet teeth 76 are disposed. In the illustrated embodiment of the invention, there are five ratchet teeth 76 in each diametrically opposed group. Each ratchet tooth 76 has a clockwise-facing abutment face 78. As best seen in FIG. 13, the abutment face 78 on ratchet tooth, 76*a* is at a substantial acute angle to the finish diameter, the abutment faces 78 of teeth 76*b*, 76*c* are at a lesser acute angle to the finish diameter, while the abutment faces 78 on teeth 76*d*, 76*e* are parallel to each other and to the direction of pull from the split mold in which the container is formed. The abutment face angle on tooth 76*a* preferably is about 37°, and abutment faces 78 on ratchet teeth 76*b* and 76*c* preferably are about 20°. In the preferred embodiment of the invention illustrated in the drawings, the angular spacing between abutment faces 78 is 20°. The ratchet teeth and abutment faces on the opposing side of the container finish are the same as illustrated in FIG. 13.

Figure 4:
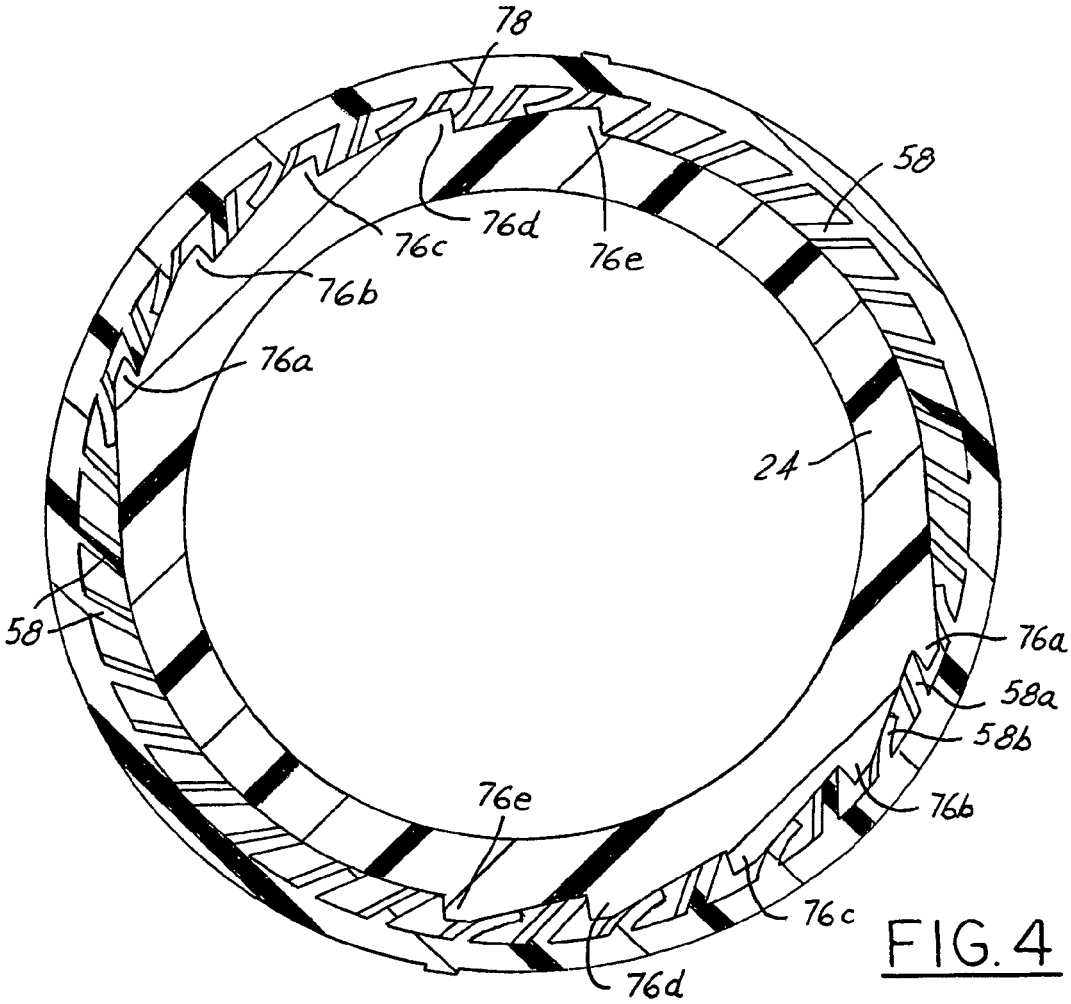
FIG. 4 is a sectional view taken substantially along the line 4-4 in FIG. 1.
Figure 5:
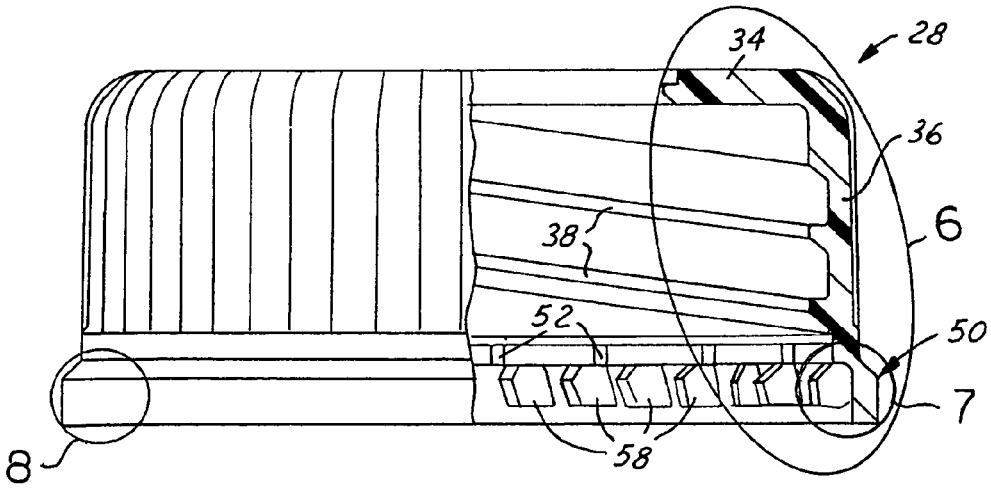
FIG. 5 is a partially sectioned elevational view of the closure shell in the package of FIGS. 1-4.
Figure 6:
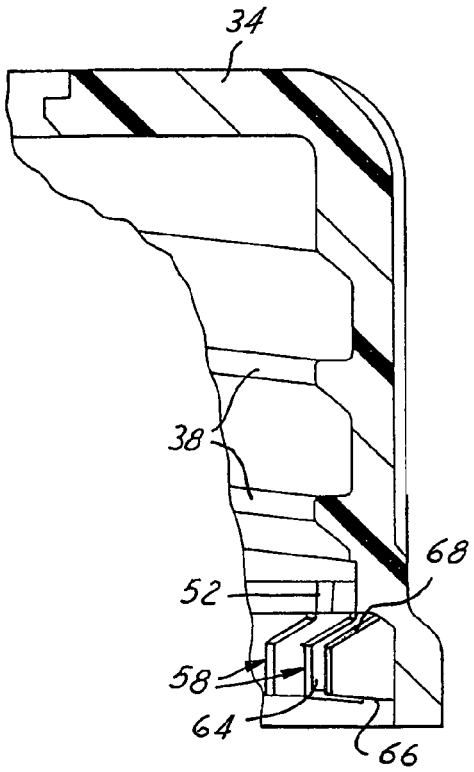
FIG. 6 is a fragmentary sectional view on an enlarged scale of the portion of FIG. 5 within the area 6.
Figure 7:
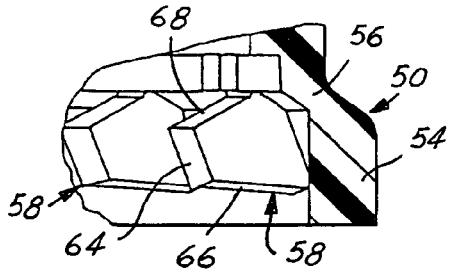
FIGS. 7 and 8 are respective fragmentary sectional views of the portions of FIG. 5 within the areas 7 and 8.

Operation of closure wings 58 and container ratchet teeth 76 is best illustrated in FIG. 4. As closure 26 is initially applied to container finish 24 by rotation in the clockwise direction as viewed in FIG. 4, closure wings 58 ramp over ratchet teeth 76. When it is then attempted to remove closure 26 from the container finish by rotation in the counterclockwise direction, wings 58 engaged the abutment faces of ratchet teeth 76, so that tamper band 50 is effectively prevented from rotating with respect to the container finish. Forced rotation of the closure shell causes fracture of the frangible connection between tamper band 50 and closure skirt 36, which separation indicates that the package has been opened. Provision of wings 58 at one-half the angular spacing between the ratchet teeth abutment faces helps ensures that the closure shell cannot be unthreaded from the container finish without rupture of the frangible connection between the tamper band and the closure skirt. For example, referring to FIG. 4, it will be seen that wing 58*a* engages the abutment face of ratchet tooth 76*a* when the closure is rotated in the counterclockwise direction with respect to the container finish. In the meantime, wing 58*b* is engaged with the cam surface of ratchet tooth 76*b*. Wing 58*b* thus is positioned to prevent reverse folding of wing 56*a* as the closure is unthreaded from the container finish, and thereby to enhance the tamper-indicating function.

Figure 14:
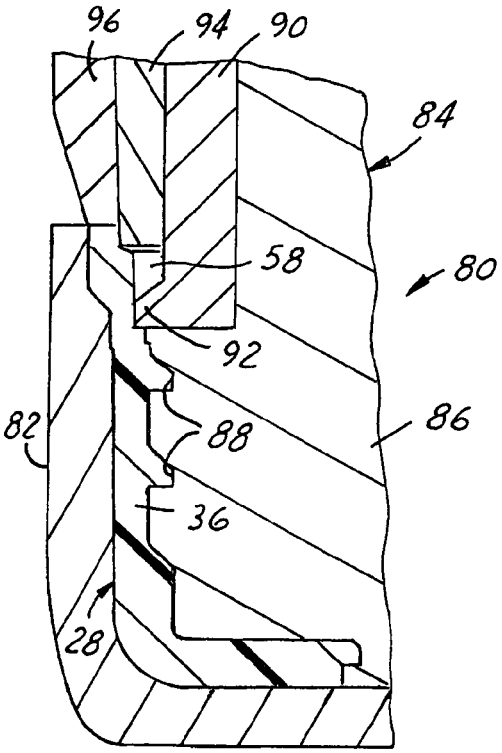
FIG. 14 is a fragmentary schematic diagram of a mold for injection molding the closure shell of FIGS. 5-9.

FIG. 14 schematically illustrates a mold 80 for injection molding closure shell 28. Mold 80 includes a mold cavity 82 and a mold core 84. Core 84 includes a threaded core 86-i.e., having external channels 88 for molding internal thread segments 38 on skirt 36. A leader ring 90 externally surrounds threaded core 86, and has an outwardly extending lip 92 for molding leaders 52 (FIGS. 5-8) and the upper surfaces 68 on wings 58. A wing sleeve 94 externally surrounds leader ring 90 for forming the pockets in which the wings 58 are molded. A stripper ring 96 externally surrounds wing sleeve 94.

Figure 15:
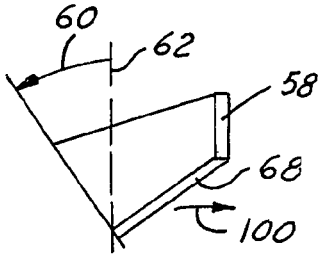
FIG. 15 is a schematic diagram useful for explaining operation of the one aspect of the present invention.
Figure 16:
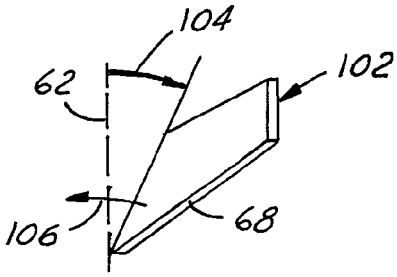
FIG. 16 is a schematic diagram similar to that of FIG. 15 and useful of explaining removal of the closure from the mold core with the wings molded at a clockwise or positive angle with respect to the container axis.

Threaded core 84 is adapted to rotate for unthreading the core from the molded closure as leader ring 90 is pulled axially away from the molded closure and stripper ring 96 pushes closure 28 off of the core. Wing sleeve 94 is free to rotate with respect to the other rings and sleeves. Leader ring lip 92 pushes on wing surfaces 68 as the closure is stripped from the core 80 (FIG. 14). With the wings 58 molded at the counterclockwise or negative angle 60 with respect to the skirt axis, as shown in FIG. 15, this pushing on wings 58 folds wings 58 in the direction 100 against the inside surface of band 50, which does not permanently deform the wings. In contrast, as shown in FIG. 16, if the wings 102 were molded at a positive or clockwise angle 104 with respect to the closure axis 62, the leader ring pushing on wing edges 68 would fold the wings in the direction 106 counter to the angle at which the wing projects from the inside surface of the tamper band, permanently distorting and deforming the wings.

There have thus been disclosed a plastic closure, a closure and container package, and a method of manufacture that fully satisfy all of the objects and aims previously set forth. The invention has been described in conjunction with a number of presently preferred aspects and in conjunction with a presently preferred embodiment, and a number of modifications and variations have been discussed. Other modifications and variations will readily suggest themselves to persons of ordinary skills in the art. For example, the invention is by no means limited to implementation in conjunction with two-piece (or multiple-piece) closure assemblies of the type illustrated in FIGS. 1-2. Indeed, the closure could as well be in the form of a one-piece integrally molded plastic shell having linerless sealing means, or having a separate liner molded in situ on the base wall of the closure, or separately formed and adhered to the base wall of the closure. The invention could also be implemented in compression molding applications in which the thread core is unscrewed from the closure, as distinguished from a straight strip from the mold core. The invention is intended to embrace these and all other modifications and variations as fall within the spirit and broad scope of the appended claims.

The invention claimed is:

1. A tamper-indicating closure that includes:

a base wall having a cylindrical skirt for removably engaging a container finish, a tamper band frangibly connected to said skirt, and a plurality of wings extending inwardly from an inner surface of said tamper band for engaging a container finish, said wings being flexibly resiliently connected to said inner surface of said band along lines that are disposed at a counterclockwise angle with respect to an axis of said skirt as viewed from inside said skirt.

2. The closure set forth in claim 1 wherein said tamper band includes a portion stepped radially outwardly with respect to said skirt and being contiguously connected to said skirt by an interconnecting wall portion, and wherein said wings are integrally connected to said interconnecting wall portion whereby stiffness of said wings to flexure with respect to said band is greater adjacent to said interconnecting wall portion than remote from said interconnecting wall portion.

3. The closure set forth in claim 1 wherein said angle is in the range of greater than 0° to 35°.

4. The closure set forth in claim 1 wherein said wings have a flat edge facing said base wall at an angle of 25° to 45° with respect to said base wall.

5. The closure set forth in claim 4 wherein said angle is 35°.

6. The closure set forth in claim 1 wherein each of said wings has a thickness in the range of 0.024 to 0.03 inch.

7. A tamper-indicating package that includes:

a container having a finish with at least one external thread segment and a plurality of external ratchet teeth spaced from said thread segment, and a tamper-indicating closure that includes:

a base wall having a skirt with at least one internal thread segment for engaging said external thread segment on said finish, a tamper band frangibly connected to said skirt, and a plurality of wings extending inwardly from an inner surface of said tamper band for engagement with said ratchet teeth on said finish, said wings being resiliently flexibly connected to said inner surface of said band along lines that are disposed at a counterclockwise angle with respect to an axis of said skirt as viewed from inside said skirt.

8. The package set forth in claim 7 wherein angular spacing between said wings is less than angular spacing between said ratchet teeth.

9. The closure set forth in claim 8 wherein said angular spacing between said wings is one-half of said angular spacing between said ratchet teeth.

10. The package set forth in claim 7 wherein said ratchet teeth are disposed in two diametrically opposed groups.

11. The package set forth in claim 10 wherein at least some of said ratchet teeth have an abutment face at an acute angle to a diameter of said finish.

12. The package set forth in claim 7 wherein said tamper band includes a portion stepped radially outwardly with respect to said skirt and being contiguously connected to said skirt by an interconnecting wall portion, and wherein said wings are integrally connected to said interconnecting wall portion such that stiffness of said wings to flexure with respect to said band is greater adjacent to said interconnecting wall portion than remote from said interconnecting wall portion.

* * * * *